US006644959B2

(12) United States Patent
Wolf et al.

(10) Patent No.: US 6,644,959 B2
(45) Date of Patent: Nov. 11, 2003

(54) ATOMIZING BURNER FOR A HEATING DEVICE OF A VEHICLE

(75) Inventors: Felix Wolf, Augsburg (DE); Bernd Mittmann, Germering (DE); Johann Sperl, Penzberg (DE); Thomas Kerscher, Munich (DE); Josef Amann, Bad Gogging (DE)

(73) Assignee: Webasto Thermosysteme International GmbH, Stockdorf (DE)

( * ) Notice: Subject to any disclaimer, the term of this patent is extended or adjusted under 35 U.S.C. 154(b) by 0 days.

(21) Appl. No.: 10/018,081

(22) PCT Filed: Apr. 17, 2001

(86) PCT No.: PCT/EP01/04336

§ 371 (c)(1),
(2), (4) Date: May 1, 2002

(87) PCT Pub. No.: WO01/79755

PCT Pub. Date: Oct. 25, 2001

(65) Prior Publication Data

US 2002/0136997 A1 Sep. 26, 2002

(30) Foreign Application Priority Data

Apr. 17, 2000 (DE) ..... 100 19 198

(51) Int. Cl.[7] ..... F23Q 7/06; F23D 14/12; F23D 14/46

(52) U.S. Cl. ..... 431/258; 431/347; 431/350; 431/353

(58) Field of Search ..... 431/258, 350, 431/347, 353, 264, 338

(56) References Cited

U.S. PATENT DOCUMENTS

| | | | | | |
|---|---|---|---|---|---|
| 3,603,711 | A | * | 9/1971 | Downs | 431/352 |
| 4,225,305 | A | | 9/1980 | Hazard et al. | |
| 5,102,328 | A | * | 4/1992 | Robinson | 431/116 |
| 5,391,075 | A | * | 2/1995 | Robinson et al. | 431/258 |
| 5,527,180 | A | * | 6/1996 | Robinson et al. | 431/258 |
| 6,162,049 | A | * | 12/2000 | Pellizzari et al. | 431/326 |

FOREIGN PATENT DOCUMENTS

| | | |
|---|---|---|
| DE | 28 10 193 A1 | 9/1979 |
| DE | 39 01 126 A1 | 7/1990 |
| FR | 2 269 031 A1 | 11/1975 |
| WO | WO 87/00605 A1 | 1/1987 |

* cited by examiner

*Primary Examiner*—Alfred Basichas
(74) *Attorney, Agent, or Firm*—Nixon Peabody LLP; David S. Safran

(57) ABSTRACT

The invention relates to an atomizer burner for a motor vehicle heater, with a cobustion chamber which contains a baffle barrier and with an atomizer means (2) which atomizes the fuel into the combustion chamber, characterized in that within the combustion chamber in the atomization direction of the fuel at a distance from the atomization point of the atomizer means (2) which is smaller than the diameter of the combustion chamber or the diameter of a cylindrical heat shield (8) which extends in the combustion chamber there is a baffle plate (18) which acts as a baffle barrier.

21 Claims, 5 Drawing Sheets

ATOMIZING BURNER FOR A HEATING DEVICE OF A VEHICLE

BACKGROUND OF THE INVENTION

1. Field of the Invention

The present invention generally relates to an atomizer burner for a motor vehicle heater. In particular, the present invention relates to such an atomizer burner having a baffle plate.

2. Description of the Related Art

Atomizer burners with which the energy bound in fossil fuels can be converted into heat energy are already in use in the various fields as exemplified by the International PCT document WO 87/00605 or the published German Patent Application DE 39 01 126 A1. In the area of motor vehicle heaters, atomizer burners or nozzle atomizer burners in the power range of less than (<) 10 kW are generally not used, since the atomization quality is not considered sufficient at smaller powers and a high electric power consumption is necessary to achieve adequate atomization quality. In addition, atomizer burners exhibit poor combustion characteristics in the partial load range since in such load range, the atomization quality is poorer than under a full load.

Finally, nozzle atomizer burners of the known type exhibit poor cold starting behavior, because based on the viscosity of the fuel which increases as the temperature decreases, the atomization quality is adversely affected. Here, large fuel droplets pass unvaporized or only partially vaporized through the combustion chamber part thus causing high starting emissions. A poor exhaust gas quality, if only during the starting phase, cannot be tolerated nowadays with consideration of the increased sensitivity of the market with respect to environmental issues.

SUMMARY OF THE INVENTION

Thus, in view of the above, the primary object of the present invention is to provide an atomizer burner for a motor vehicle heater which, even at lower powers in the partial load range and during the cold start phase, still provides good combustion behavior and low emissions.

This object and other advantages are achieved by the embodiments of the present invention described below.

In accordance with one embodiment of the present invention, an atomizer burner for a motor vehicle heater is provided with a combustion chamber part which contains a baffle barrier, and with an atomizer which atomizes the fuel into the combustion chamber part. Baffle plate which acts as a baffle barrier is provided at a distance from the atomization point of the atomizer which is smaller than the diameter of the combustion chamber part or the diameter of a cylindrical heat shield which extends in the combustion chamber part. The baffle plate which acts as the baffle barrier has the effect of flame stabilization which acts advantageously to reduce flame noise and the improve combustion, especially at smaller powers or in the partial load range of the burner. The baffle plate is especially advantageous in the implementation of compact combustion chambers for liquid fuels. The burner equipped with the baffle plate can process even poorer atomization qualities by the plate without this adversely affecting the combustion behavior. Therefore, the present invention allows improved implementation of partial load stages in which the atomization quality is poorer than in the full load stage.

The baffle plate can be conical, convex, or concave shaped, among other shapes. The arrangement of the baffle plate in the flame zone facilitates re-ignition of the fuel on the glowing disk after flame blow-off, which may be caused, for example, by air bubbles in the fuel line. In addition, CO and HC emissions can be reduced when the combustion process ends by the fuel reacting on the glowing baffle plate.

The baffle plate can be made as a disk with a collar with a height of 2 mm for instance, which extends against the atomization direction of the fuel so that it forms a cup shape which is open to the atomizer. The ratio of the baffle plate diameter to the fuel chamber diameter is preferably between 0.6 and 0.9, and the ratio of the axial distance of the baffle plate from the atomization point to the combustion chamber part diameter is preferably between 0.3 and 0.6. Suitable dimensioning of the baffle plate, compared to the other aerodynamic measures, yields only a slightly increased pressure loss in the combustion chamber part. For example, the tangential component of a combustion air flow which is delivered with a swirl is only insignificantly disrupted, so that the combustion gases can also flow downstream of the baffle plate still having a swirl component. The baffle plate is preferably fixed with mounting clips.

In one embodiment, the baffle plate can have openings in the form of slots and/or holes, the openings being made preferably in the form of defined perforation of the baffle plate. However, the baffle plate can also be made as a ring with a central through hole.

Furthermore, in one especially preferred embodiment, a chamber is provided on the baffle plate into which a glow means in the form of a glow pin, for example, of ceramic, or in the form of a glow plug, projects. By providing such an arrangement of the glow means in the area of the restricted flow upstream of the baffle plate, the starting behavior of the burner is thereby improved. The chamber is preferably made such that the glow means projects into it so that the radiant energy of the glow means can be used downstream of the atomization device to heat the components of the baffle plate. In this way, the starting characteristics of one such burner is greatly improved.

The baffle plate can, among others, be fixed on the combustion chamber part, on the combustion chamber bottom, or on aerodynamic internals, for example, a swirling device for the combustion air.

The baffle plate may preferably be made of high-alloy steel, of ceramic or of ceramic-coated steel.

These and other advantages and features of the present invention will become more apparent from the following detailed description of the preferred embodiments of the present invention when viewed in conjunction with the accompanying drawings.

DETAILED DESCRIPTION OF THE INVENTION

Figure 1:
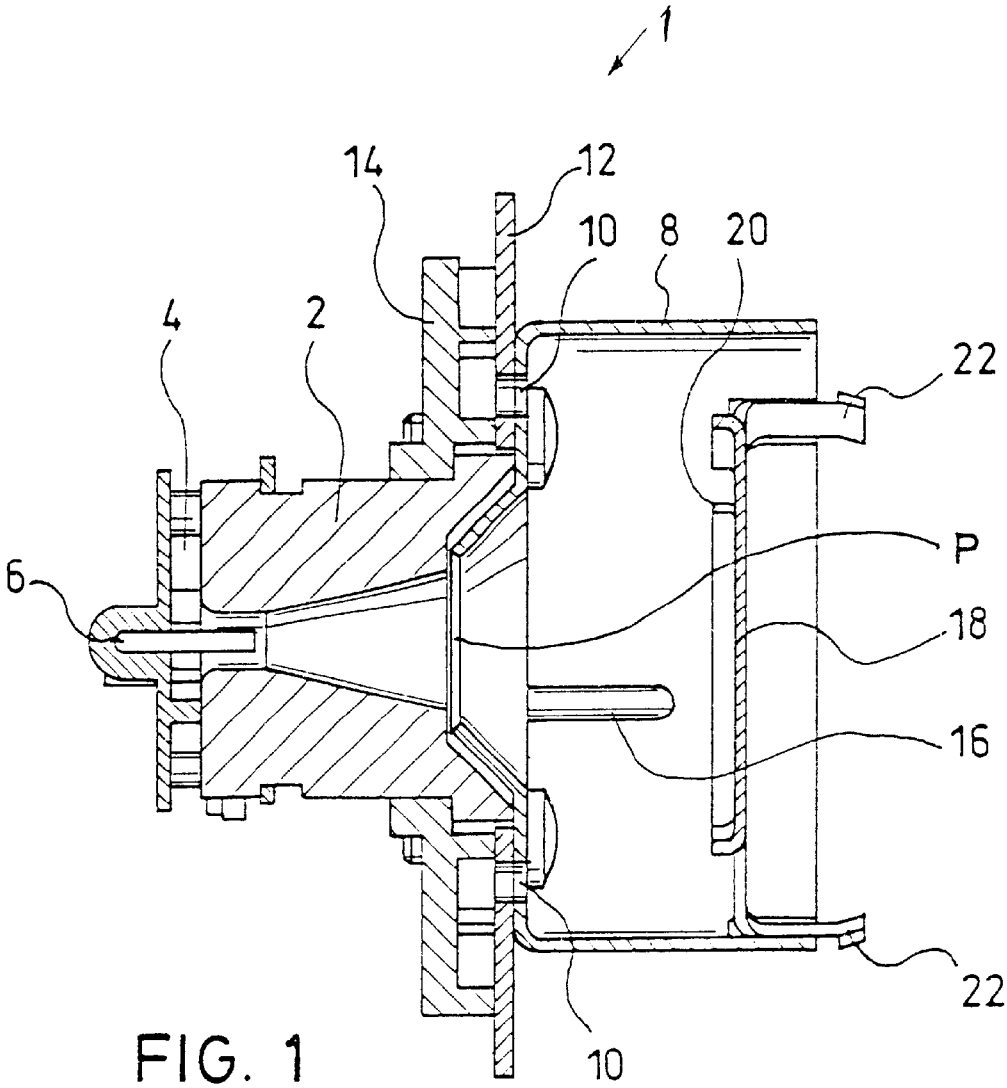
FIG. 1 shows a cross-sectional view an atomizer burner in accordance with one embodiment of the present invention.
Figure 5:
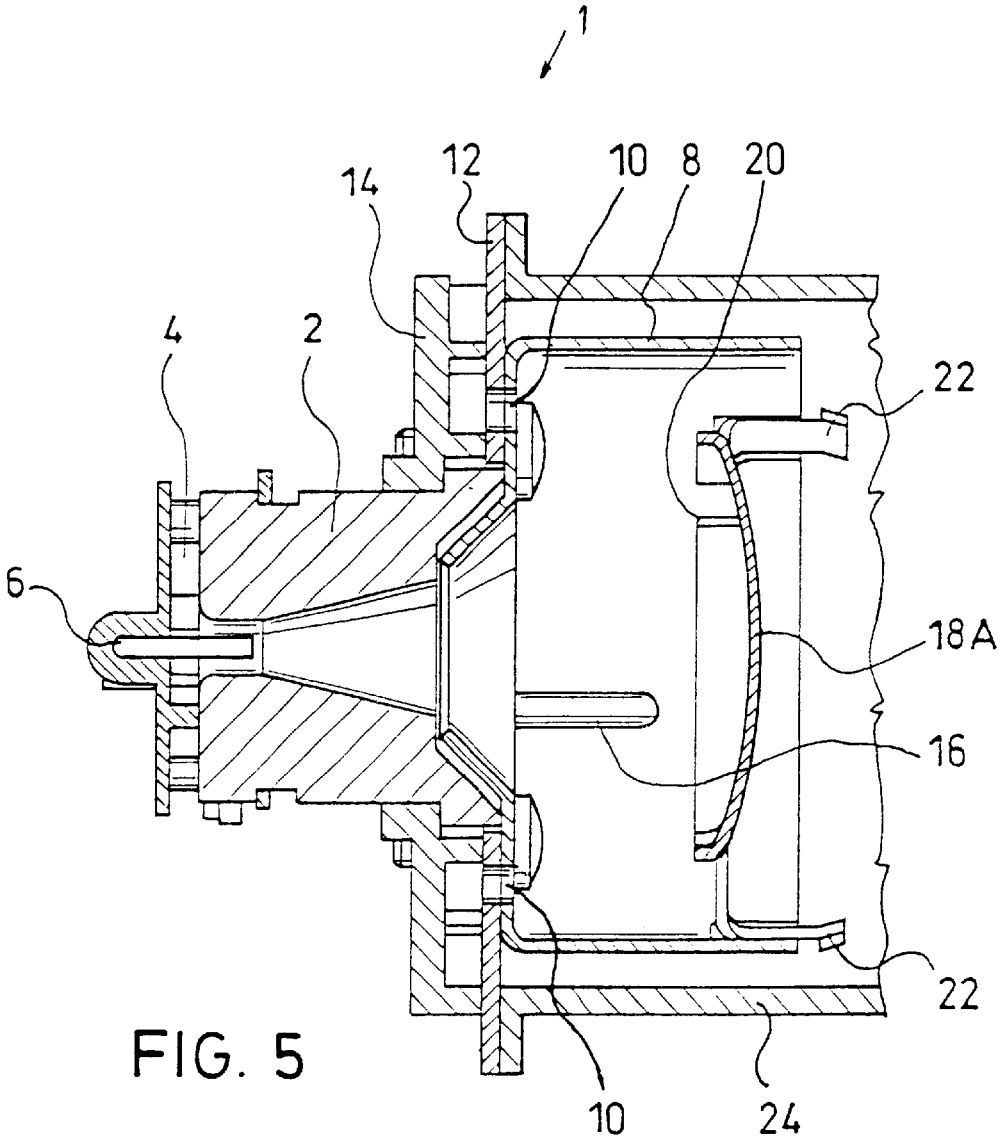
FIG. 5 shows another embodiment of the atomizer burner of FIG. 1 but with a concave baffle plate.

FIG. 1 shows a cross sectional view of one preferred embodiment of an atomizer burner 1. The atomizer burner 1 of this embodiment includes an atomizer such as the atomizer nozzle 2 to which an air-guide 4 that swirls the combustion air entering the atomizer nozzle 2 is connected in series. Of course, in other embodiments, other types of atomizers may be used as well. Upstream of the air-guiding device 4, on the left side in the illustrated example, there is a fuel feed line 6 through which the fuel to be atomized in the atomizer such as the shown atomizer nozzle 2 is supplied. The atomizer nozzle 2 is connected to the cylindrical heat shield 8 on its side facing the combustion chamber part 24 which is shown in the embodiment of FIG. 5. This heat shield 8 can be provided with secondary air openings 10 which are also provided in the flange 12 located upstream of the heat shield 8 which can also be used to attach the atomizer nozzle 2 within the combustion chamber part or within the motor vehicle heater. The secondary air which passes through these holes 10 is subjected to a swirl by the air-guiding swirling device 14. The atomizer burner 1 shown in the present embodiment is also provided with a glow means 16 with which the atomized fuel mixture is ignited, the glow means 16 preferably being a glow pin or a glow plug made of a ceramic material. Optionally, in addition to the glow means 16, there is also provided an ignition means (not shown) which may be used to produce an ignition spark as practiced in conventional atomizer burners.

As also shown in the embodiment of FIG. 1, on the heat shield 8 of the burner 1, there is a baffle barrier in the form of a baffle plate 18 which is flat in the illustrated example, the baffle plate 18 being located perpendicular to the lengthwise axis of the combustion chamber part 24. Fuel which is atomized in the atomizer nozzle 2 and which can emerge in the form of fuel droplets due to inadequate fuel preparation, strikes the baffle barrier which is made as a flat baffle plate 18 and can vaporize there on the baffle plate. The baffle barrier, in this case, the baffle plate 18, is located within the flame zone of the burner so that flame stability is improved. Moreover, the baffle plate 18 acts to deflect the flow and thus, to stabilize the flame.

The baffle plate 18 is preferably made of high-alloy steel and may be made as a disk having a collar 20 roughly 2 mm in height which extends against the atomization direction of the fuel so that it forms a cup shape which is open to the atomizer nozzle 2. Alternatively, the baffle plate 18 can also be made of ceramic material or a high-alloy steel coated with a ceramic material. As can also be seen in FIG. 1, the baffle plate 18 is attached to the heat shield 8 using mounting clips 22.

Other embodiments of baffle plates are discussed herein below referring to various figures which show the burner with the various embodiments of the baffle plates. It should be noted that the in these figures, common numerals are used to identify common components, the various embodiments of the baffle plates being distinguished using letter designations A, B, C and D.

Figure 2:
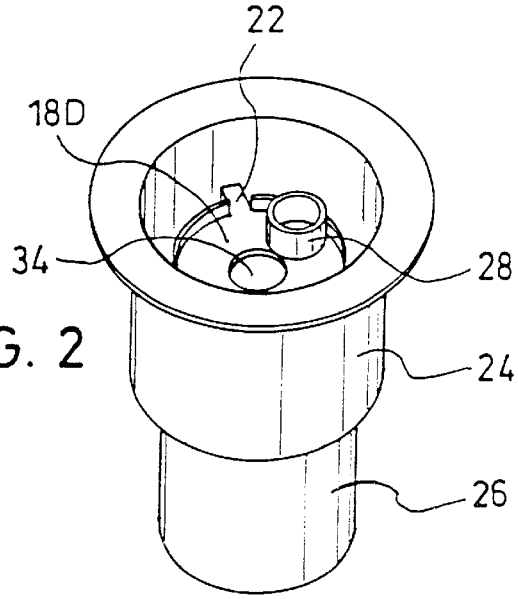
FIG. 2 shows a perspective view of a combustion chamber part with a flame tube in accordance with one embodiment.

FIG. 2 is a perspective view of a combustion chamber part 24 which is provided with a baffle plate 18D, there being a flame tube 26 on the back of the combustion chamber part 24. The baffle plate 18D which is made in this embodiment as a disk with a central through hole 34 so as to have a ring shape, is attached via mounting clips 22 in the combustion chamber part 24. As shown furthermore by FIG. 2, on the baffle plate 18D, there is a starting chamber 28 into which a glow means can project. Areas of the baffle plate 18D may be used as a "hot-spot" in order to heat the starting chamber 28 or the baffle plate 18D. In addition, the starting chamber 28 is also used as a damping zone in which a pilot flame is formed more quickly and which accelerates the vaporization of the atomized fuel, thus leading to faster ignition when the burner starts.

As is apparent, the starting chamber 28 in this embodiment is located on the edge of the baffle plate 18D. Alternatively, it can also be attached at any other point on the baffle plate, especially when the baffle plate 18 is flat, or can be made molded with it. The position of the starting chamber 28 is ultimately determined by the position of the glow means.

Figure 3:
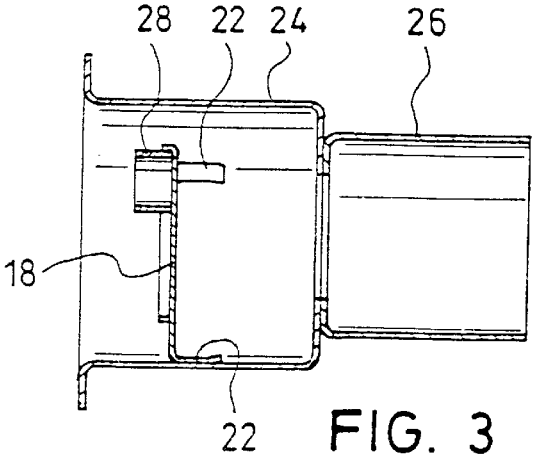
FIG. 3 shows a cross-sectional view of the combustion chamber part shown in FIG. 2.
Figure 4:
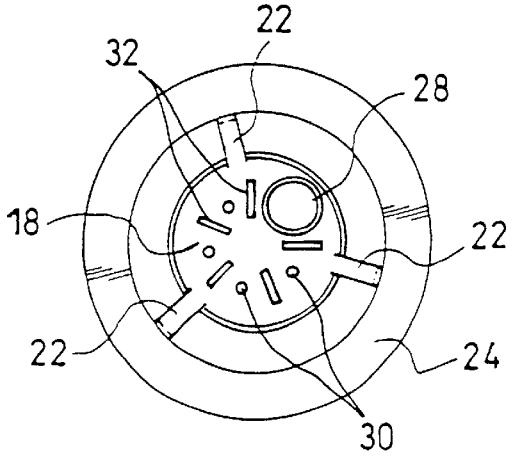
FIG. 4 shows an overhead view of the baffle plate of the combustion chamber part shown in FIG. 2.

The combustion chamber part 24 in FIGS. 2 to 4 is combined with the burner 1 such as that shown in FIG. 1 such that the heat shield 8 is inserted preferably inside into the combustion chamber part 24, again the baffle plate 18 being attached in the present embodiment to the combustion chamber part 24. Thus, the baffle plate 18 may be attached to the heat shield 8 as shown in FIG. 1, or alternatively, be attached to the combustion chamber part 24 as is shown in FIGS. 2 to 4. The heat shield 8 may also be mounted on the combustion chamber part 24, in this case there being recesses in the heat shield 8.

In the embodiment of the baffle plate 18 shown in FIG. 4, the baffle plate 18 is provided with holes 30 and slots 32. These holes 30 and slots 32 are optional. The baffle plate 18 in various embodiments may thus be provided with a given pattern of holes, with only one or more holes 30, with one or more slots 32, or as shown, with combinations of holes 30 and slots 32.

In the embodiment of the atomizer burner 1 shown in FIG. 5, the baffle plate 18A is concave in shape. Furthermore, as previously noted, this figure shows the combustion chamber part 24 which surrounds the outside of the heat shield 8. In this regard, it should be noted that the other illustrated embodiments also include such combustion chamber part 24 as well but have been omitted for clarity.

Figure 6:
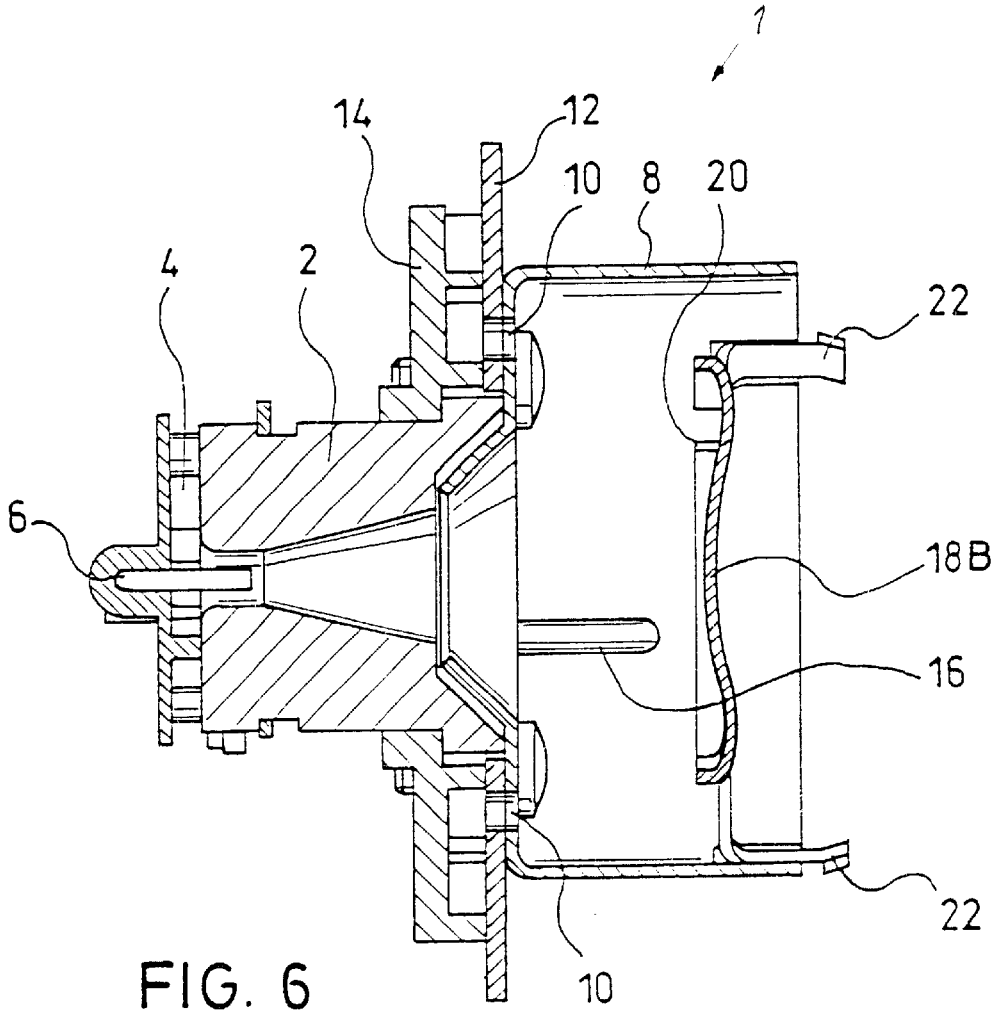
FIG. 6 shows yet another embodiment of the atomizer burner of FIG. 1 but with a convex baffle plate.

In the embodiment of the atomizer burner 1 shown in FIG. 6, the baffle plate 18B is made convex in shape, i.e. with an arch pointed in a direction opposite the atomizer nozzle 2.

Figure 7:
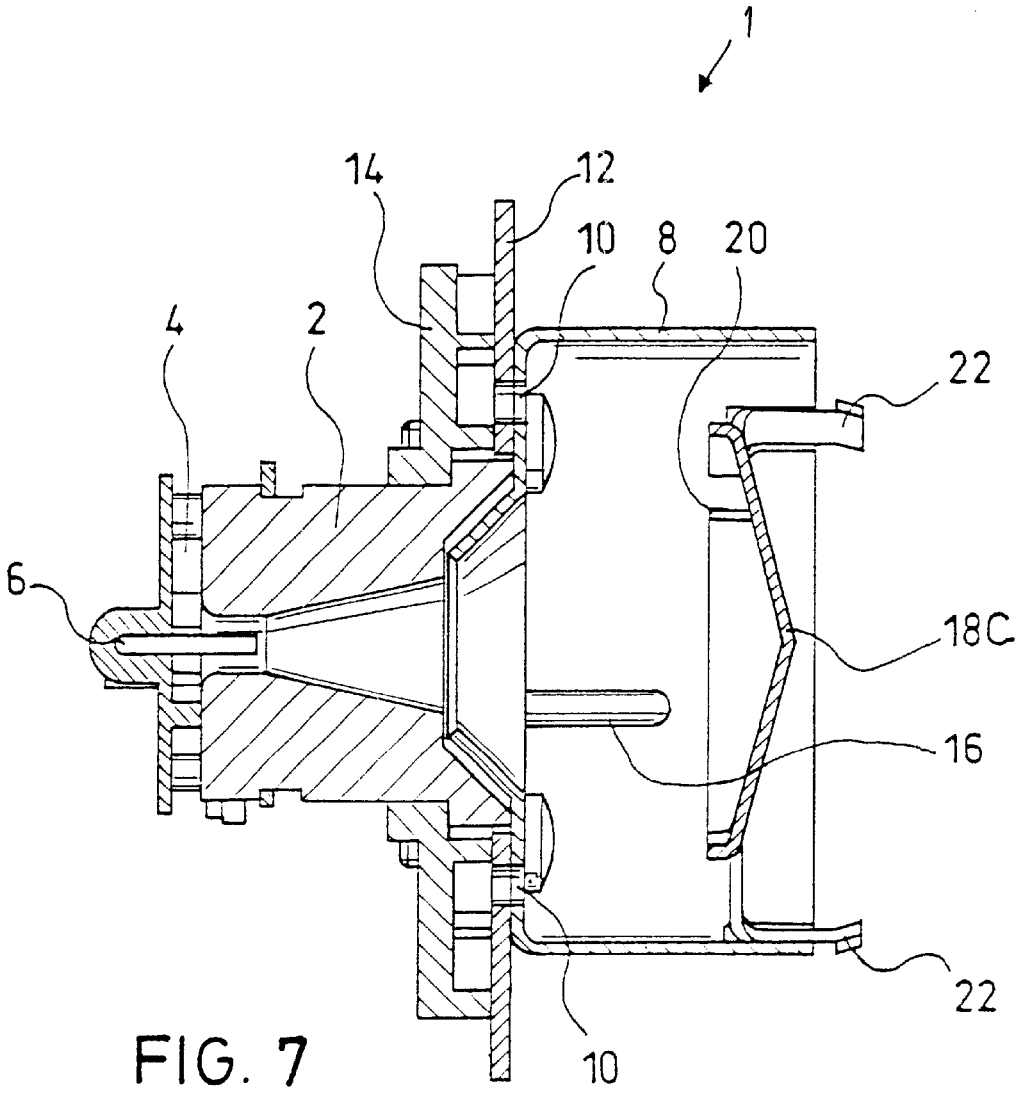
FIG. 7 shows still another embodiment of the atomizer burner of FIG. 1 but with a conical baffle plate.

In the embodiment of the atomizer burner 1 shown in FIG. 7, the baffle plate 18C is made conical in shape. Of course, in another embodiment, the tip of the cone of the baffle plate 18C can also be pointed in a direction opposite to that shown.

In the various embodiments shown and discussed above, it is advantageous if the ratio of the axial distance of the baffle plate 18, 18A, 18B, 18C and 18D from the atomization point P shown in FIG. 1 to the diameter of the combustion chamber part 24 is roughly between 0.3 and 0.6. Likewise, in the various embodiments shown and discussed above, it is advantageous if the ratio of the diameter of the baffle plate 18, 18A, 18B, 18C, and 18D to the diameter of the combustion chamber part 24 or the diameter of the heat shield 8 located in the combustion chamber part 24 is roughly between 0.6 and 0.9. At these numerical ratios, very good combustion results have been shown in operation.

The baffle plates described above which acts as the baffle barrier has the effect of flame stabilization which acts advantageously to reduce flame noise and the improve combustion, especially at smaller powers or in the partial load range of the burner. The baffle plate is especially advantageous in the implementation of compact combustion chambers for liquid fuels. The burner equipped with the baffle plate can process even poorer atomization qualities by the plate without this adversely affecting the combustion behavior. Therefore, the present invention allows improved implementation of partial load stages in which the atomization quality is poorer than in the full load stage. As described above, the baffle plate may be conical, convex, or concave shaped, among other shapes. The arrangement of the baffle plate in the flame zone facilitates re-ignition of the fuel on the glowing disk after flame blow-off, which may be caused, for example, by air bubbles in the fuel line. In addition, CO and HC emissions can be reduced when the combustion process ends by the fuel reacting on the glowing baffle plate.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. Atomizer burner for a motor vehicle heater comprising:

a combustion chamber part within which fuel is combusted;

an atomizer having an atomization point at which the fuel is atomized into the combustion chamber part; and a baffle plate within the combustion chamber part, the baffle plate being positioned from the atomization point of the atomizer at a distance which is less than the diameter of the combustion chamber part for vaporizing unatomized fuel droplets which emerge from the atomizer.

2. Atomizer burner as claimed in claim 1, further including a heat shield which extends into the combustion chamber part.

3. Atomizer burner as claimed in claim 2, wherein the distance of the baffle plate from the atomization point of the atomizer is less than the diameter of the heat shield.

4. Atomizer burner as claimed in claim 1, wherein the baffle plate is conical in shape.

5. Atomizer burner as claimed in claim 1, wherein the baffle plate is convex in shape.

6. Atomizer burner as claimed in claim 1, wherein the baffle plate is concave in shape.

7. Atomizer burner as claimed in claim 1, wherein the baffle plate is a disk with a collar that extends in a direction opposite direction of atomization the fuel to form a cup shape open to the atomizer.

8. Atomizer burner as claimed in claim 1, wherein a ratio of the diameter of the baffle plate to the diameter of the combustion chamber part is approximately between 0.6 and 0.9.

9. Atomizer burner as claimed in claim 2, wherein a ratio of the diameter of the baffle plate to the diameter of the heat shield located in the combustion chamber part is approximately between 0.6 and 0.9.

10. Atomizer burner as claimed in claim 1, wherein a ratio of the distance of the baffle plate from the atomization point to the diameter of the combustion chamber part is approximately between 0.3 and 0.6.

11. Atomizer burner as claimed in claim 1, wherein the baffle plate has at least one opening extending through the baffle plate, the at least one opening being at least one of a slot and a hole.

12. Atomizer burner as claimed in claim 1, wherein the baffle plate is ring shaped.

13. Atomizer burner as claimed in claim 1, further including a glow means for igniting atomized fuel.

14. Atomizer burner as claimed in claim 13, wherein the glow means is at least one of a glow pin and a glow plug.

15. Atomizer burner as claimed in claim 1, wherein the baffle plate is made of a high-alloy steel.

16. Atomizer burner as claimed in claim 1, wherein the baffle plate is made of a ceramic.

17. Atomizer burner as claimed in claim 1, wherein the baffle plate is made of a ceramic-coated steel.

18. Atomizer burner as claimed in claim 1, wherein said baffle plate is arranged perpendicular to a lengthwise axis of the combustion chamber part.

19. Atomizer burner as claimed in claim 1, wherein said baffle plate is located in a flame zone of the combustion chamber part.

20. Atomizer burner as claimed in claim 13, wherein said baffle plate is located in a zone of radiant energy produced by the glow means.

21. Atomizer burner for a motor vehicle heater comprising:

a combustion chamber part;

an atomizer having an atomization point which atomizes the fuel into the combustion chamber part;

a baffle plate within the combustion chamber part, the baffle plate being positioned from the atomization point of the atomizer at a distance which is less than the diameter of the combustion chamber part; and a glow means for igniting atomized fuel wherein the baffle plate includes a chamber into which the glow means projects.

* * * * *